United States Patent [19]

Koontz

[11] Patent Number: 4,821,161

[45] Date of Patent: Apr. 11, 1989

[54] LIGHT FIXTURE

[75] Inventor: William D. Koontz, Jonesboro, Ark.

[73] Assignee: Design Products, Co., Inc., Jones, Ark.

[21] Appl. No.: 134,062

[22] Filed: Dec. 17, 1987

[51] Int. Cl.[4] ..... F21S 1/06

[52] U.S. Cl. ..... 362/364; 362/439; 362/296; 439/456

[58] Field of Search ..... 362/147, 148, 362, 364, 362/373, 437, 439, 448, 296, 374, 457, 433, 453, 454; 439/456, 465, 470, 611-619, 458

[56] References Cited

U.S. PATENT DOCUMENTS

| | | | |
|---|---|---|---|
| 1,294,986 | 2/1919 | Wesner | 439/615 |
| 2,716,185 | 8/1955 | Burliuk et al. | 362/364 |
| 2,992,323 | 7/1961 | Fletcher | 362/439 |
| 3,858,160 | 12/1974 | Denton | 439/465 |
| 3,909,101 | 9/1975 | Bruels | 439/465 |
| 4,048,491 | 9/1977 | Wessman | 362/364 |
| 4,158,474 | 6/1979 | MacGraw, II | 439/339 |
| 4,214,135 | 7/1980 | Munroe | 439/456 |
| 4,232,361 | 11/1980 | Kelsall | 362/364 |
| 4,426,677 | 1/1984 | Dennis | 362/439 |
| 4,529,258 | 7/1985 | Anthony | 439/142 |
| 4,729,080 | 3/1988 | Fremont et al. | 362/148 |

*Primary Examiner*—Ira S. Lazarus
*Assistant Examiner*—D. M. Cox
*Attorney, Agent, or Firm*—Finnegan, Henderson, Farabow, Garrett & Dunner

[57] ABSTRACT

A light fixture suitable for attachment without a junction box is shaped as a one piece thermoplastic cylindrical receptacle with one end closed. An inner surface of the closed end forms an axially extending molded socket in which a bulb screwshell is centrally disposed and to which a light reflector is attached. At the outer surface of the closed end is a circular cavity containing all the electrical connections, including the contacts, the wire terminals and the cord guides for holding an electrical cord in position. Conductive metal strips connect the contacts and the wire terminals and are recessed in the circular cavity. The cavity is covered by a cap with a protruding annular rib which when fastened bends the electrical cord supported by the cord guides into clamping engagement with the outer surface of the closed end for securing the cord against pull and strain forces on the wire connectors.

15 Claims, 4 Drawing Sheets

LIGHT FIXTURE

BACKGROUND OF THE INVENTION

The present invention relates to electric light fixtures and, more particularly, to fixtures of the type suitable for attachment without a junction box.

A typical light fixture of the type suitable for attachment without a junction box uses a socket and a fixture case which are separate elements, requiring the assembly step of attaching the independent socket to the independent fixture case. Such conventional fixtures, which include desk lamps, floor lamps and the like, use a lamp socket assembly having a metal "screwshell" for holding a light bulb. The screwshell is usually enclosed in either a paper sleeve or a porcelain receptacle.

In fabricating a light fixture of the type suitable for attachment without a junction box, it is important to provide for pull and strain relief for the electrical cord or insulated wire to which the light fixture is connected. This is to prevent the possibility of damage to the socket assembly and resultant shock hazard which can result, for example, from electrical short circuits caused by forces exerted at points of electrical connection via movement of the cord or wire. Typically a knot is placed in the cord or wire to constrain such movement within a light fixture, or a plastic strain relief bushing is mounted in the junction box or fixture, thus averting such forces at the points of electrical connection.

Additionally, in fabricating a light fixture of the type suitable for atachment without a junction box, it is desirable to provide for remote operation of the fixture via an external switching circuit which is independent of the external main circuit.

SUMMARY OF THE INVENTION

An object of the present invention is to provide a light fixture which is durable, lightweight, inexpensive to manufacture, and relatively easy to assemble and install.

Another object is to provide a light fixture which can be readily connected safely, with provision for pull and strain relief, to a source of power without using a junction box.

To achieve the foregoing objects, and in accordance with the invention as embodied and broadly described herein, a light fixture is provided comprising a unipartite thermoplastic hollow annular receptacle having a closed end with an inner and an outer surface; a cylindrical screwshell centrally mounted in the receptacle and fastened to the inner surface of the closed end; a plurality of spaced conductive contact means disposed in the screwshell and extending to the outer surface of the closed end; a plurality of wire connectors connected to respective contact means on the outer surface for connecting one end of a wire thereto; a light reflector mounted inside and facing the open end of the the hollow receptacle, having a converging end with a central opening adjacent to the closed end of the receptacle for receiving the screwshell; a plurality of cord guide means formed on the outer surface of the closed end adjacent to the wire connectors; and a cover means removably fastened to the outer surface of the closed end, having projection means aligned with and spaced from the plurality of cord guide means for bending an electrical cord supported by the cord guide means into clamping engagement with the outer surface of the closed end for securing the cord against pull and strain forces on a respective wire connector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The accompanying drawings which are incorporated in and constitute a part of the specification, illustrate a preferred embodiment of the invention and, together with the summary description given above and the detailed description of the preferred embodiment including the appended claims given below, serve to explain the principles of the invention.

DESCRIPTION OF THE PREFERRED EMBODIMENT

Figure 1:
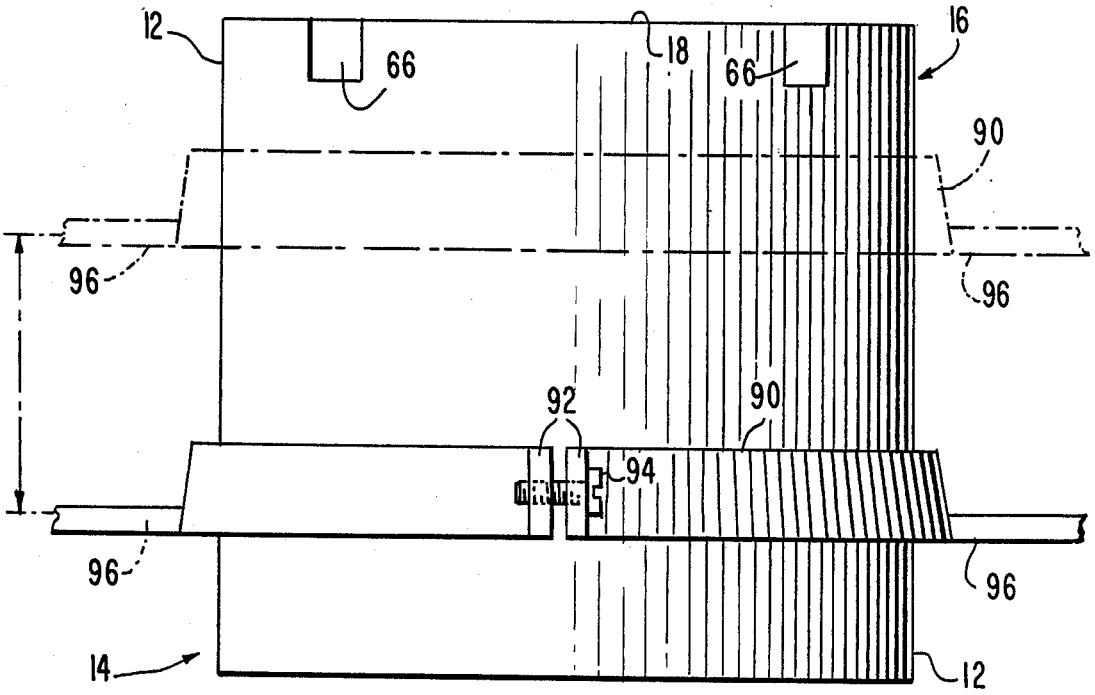
FIG. 1 is an elevational view of an electric light fixture incorporating the teachings of the present preferred embodiment of the invention, in mounting position showing in phantom the adjustable bracket in an alternate axial position.

Reference will now be made in detail to the present preferred embodiment of the invention as illustrated in the accompanying drawings wherein like reference numerals refer to like parts.

A preferred embodiment of the light fixture is shown in FIGS. 1–8 and is represented generally by the numeral 10. In accordance with the invention, light fixture 10 comprises a unipartite thermoplastic hollow annular receptacle having an open end and a closed end with inner and outer surfaces. As embodied herein, and referring to the drawings, unipartite thermoplastic hollow annular receptacle 12 has an open end 14 and a closed end 16 for defining a chamber 17 internal to receptacle 12. Closed end 16 has an outer surface 18 and an inner surface 20 forming the bottom of chamber 17.

Figure 3:
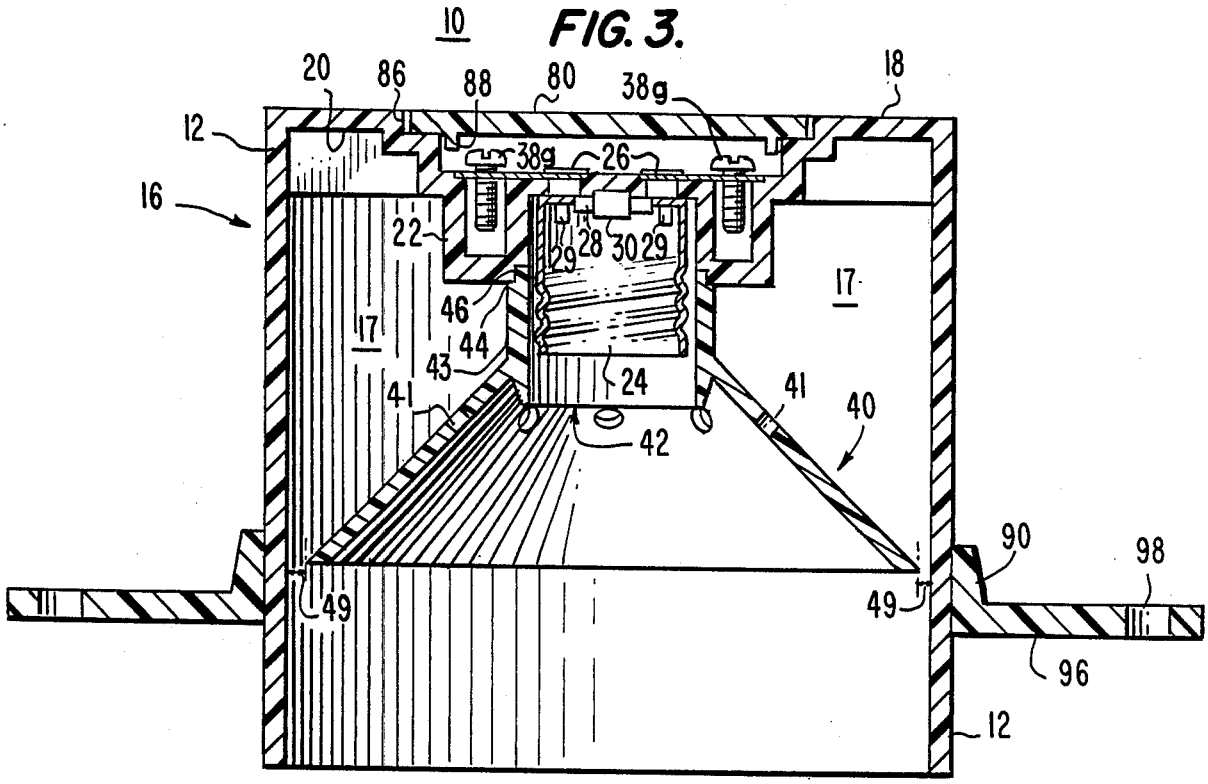
FIG. 3 is a sectional view of the fixture illustrated in FIG. 1 (taken along line A—A of FIG. 5)
Figure 4:
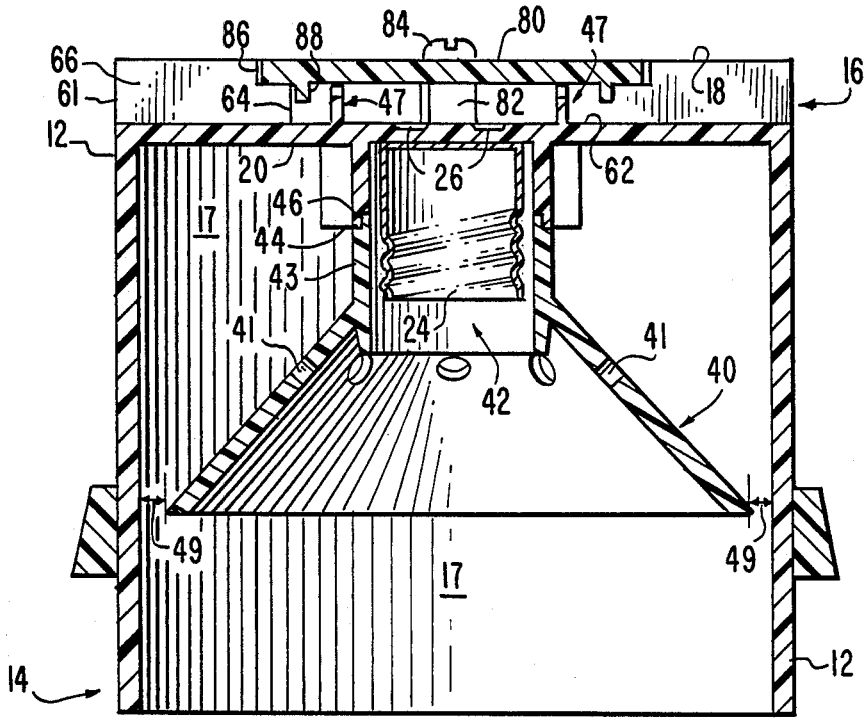
FIG. 4 is a sectional view of the fixture illustrated in FIG. 1 (taken along line B—B of FIG. 5)

In accordance with the invention, a cylindrical screwshell is centrally mounted in the receptacle. As herein embodied, as best illustrated in FIGS. 3 and 4, closed end 16 has a hollow cylindrical socket portion 22 extending coaxially with receptacle 12 from inner surface 20 into chamber 17. Socket portion 22 has a diameter for loosely receiving screwshell 24 and an axial length that may terminate at approximately one-half the length of the screwshell, facilitating installation of the screwshell. Screwshell 24 may be a conventional metallic screwshell for threadably receiving a light bulb base (not shown).

Figure 2:
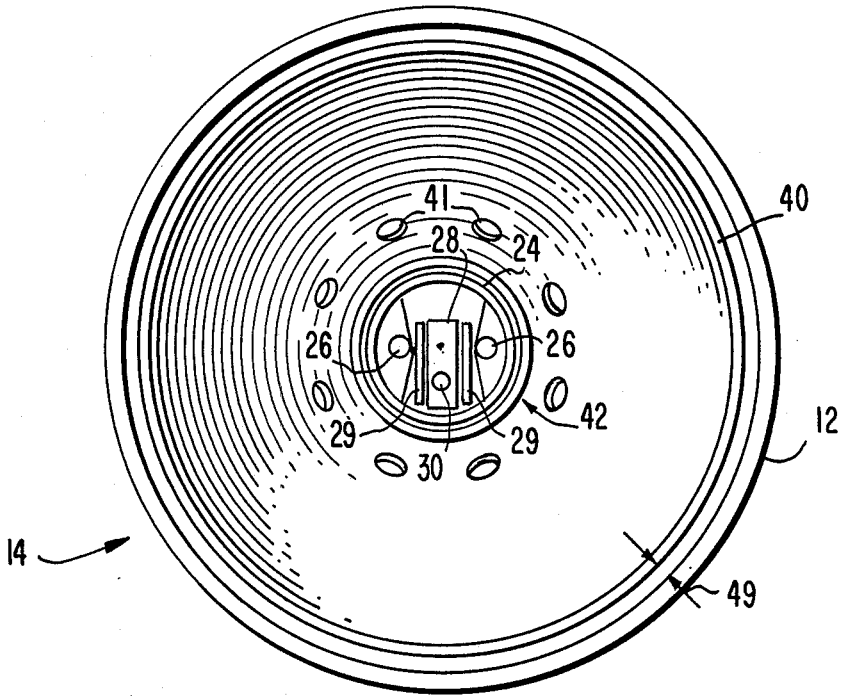
FIG. 2 is a bottom view of the fixture illustrated in FIG. 1.
Figure 5:
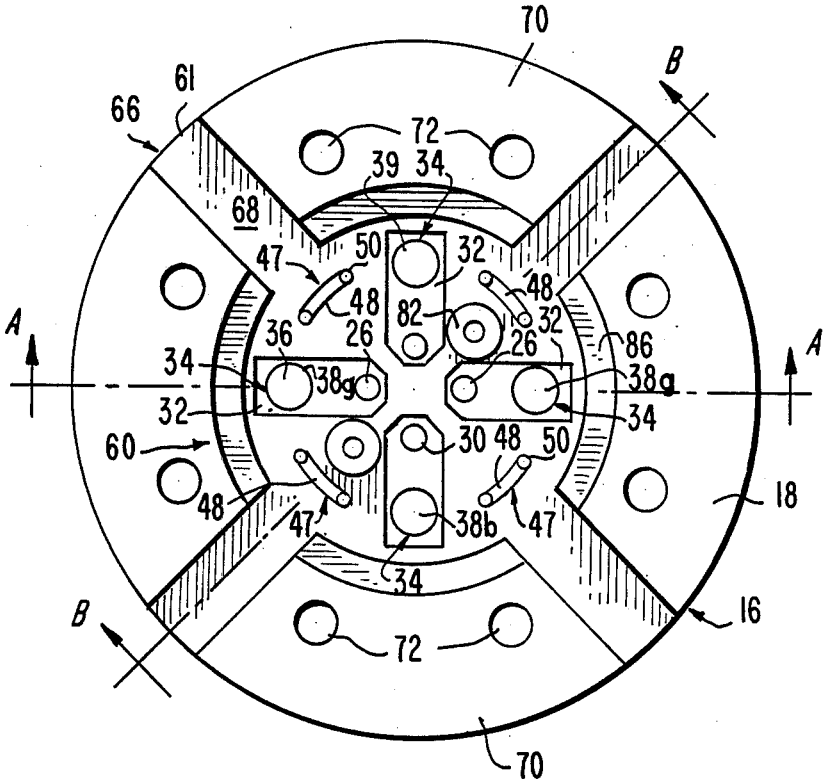
FIG. 5 is a top view of the fixture illustrated in FIG. 1, with the cap removed.

According to the invention, a plurality of spaced conductive contact means are disposed in the screwshell 24 and extend to the outer surface 18 of the closed end 16. In the preferred embodiment, as best illustrated in FIGS. 2, 3 and 5, screwshell 24 is attached to inner surface 20 of closed end 16 by hollow metallic rivets 26 which extend through to outer surface 18 of closed end 16. Bulb contact 28 is centrally disposed in screwshell 24 and attached to inner surface 20 of closed end 16 by a hollow metallic rivet 30. The contact 28 is disposed in a shaped recess (not shown) formed on inner surface 20 and having opposed ridges 29 protruding from the inner surface 20 in order to prevent twisting motion of the contact 28 upon installation of a bulb base (not shown) in screwshell 24.

The invention further includes a plurality of wire connectors connected to respective contact means on the outer surface of the closed end. As embodied herein and referring to FIGS. 5 and 7, hollow metallic rivets 26 and 30 each terminate adjacent one end of corresponding radially extending shaped recess 31 in outer surface 18 of closed end 16. Disposed in each shaped recess 31 in which rivets 26 and 30 terminate is a correspondingly configured metallic strip 32 with openings 34 adjacent to the ends opposite the respective rivets 26 and 30 of strips 32. Closed end 16 has a bore 36 aligned with each opening 34, for receiving the shank of a metallic wire connecting screws **38*g* and 38*b* threaded in a respective opening 34 adjacent hollow metallic rivets 26 and 30, respectively. Connecting screws 38*g* define the ground terminals. Connecting screw 38*b* defines the bulb contact terminal. Another bore 36 is aligned with opening 34 in a shaped recess 31, for receiving the shank of wire connecting screw 39 spaced diametrically opposite connecting screw 38*b*. Connecting screw 39 defines the dead or open wire terminal, which is spaced from and electrically insulated from the wire connecting terminals 38*g* and 38*b***.

According to the invention, a light reflector is mounted in the receptacle. The light reflector has a central opening adjacent to closed end, for receiving the screwshell 24, and faces the open end of the receptacle. As embodied herein and referring to FIG. 3, reflector 40 is frustro-conical in configuration and has a central opening in the form of a hollow cylindrical extension 43 at the converging end for receiving a portion of screwshell 24. Inner edge of cylindrical extension 43 has a shoulder 44 which mates with a shoulder 46 on outer edge of socket portion 22 for mounting the reflector 40 in the chamber 17. Cylindrical extension 43 may be attached to socket portion 22 by cementing or welding, for example. Preferably, reflector 40 is thermoplastic with a light reflective coating thereon (not shown) and has a diameter at the end opposite cylindrical extension 43 which forms a predetermined annular gap represented by arrows 49 between the reflector 40 and the receptacle 12. Reflector 40 may be provided with vents 41 for heat dissipating air flow axially through receptacle 12, and around annular gap 49.

Figure 7:
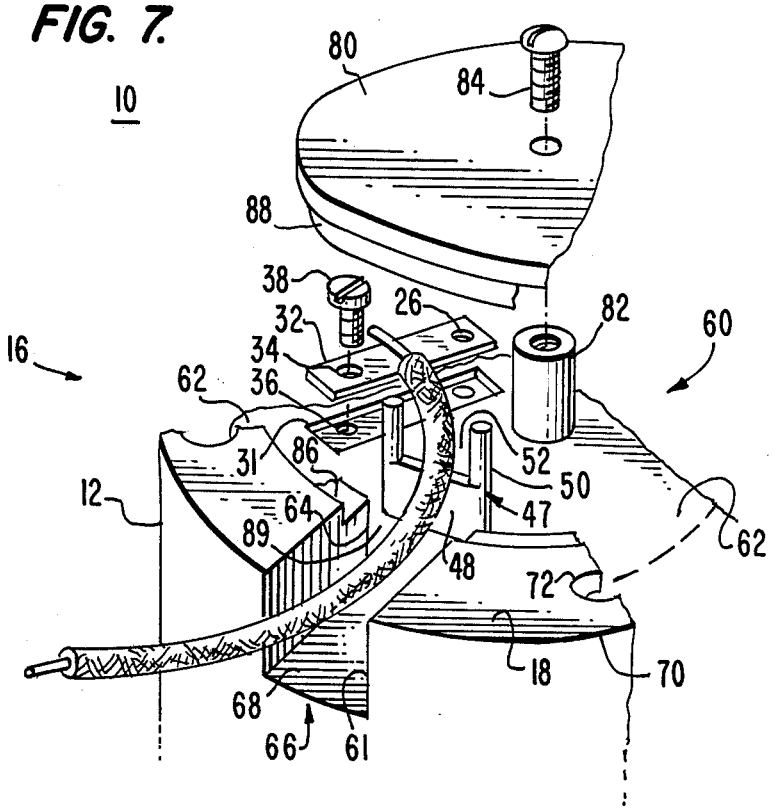
FIG. 7 is an enlarged fragmentary view in perspective of the present preferred embodiment, illustrating an electrical cord entering through the viaduct and resting on the cord guide.
Figure 8:
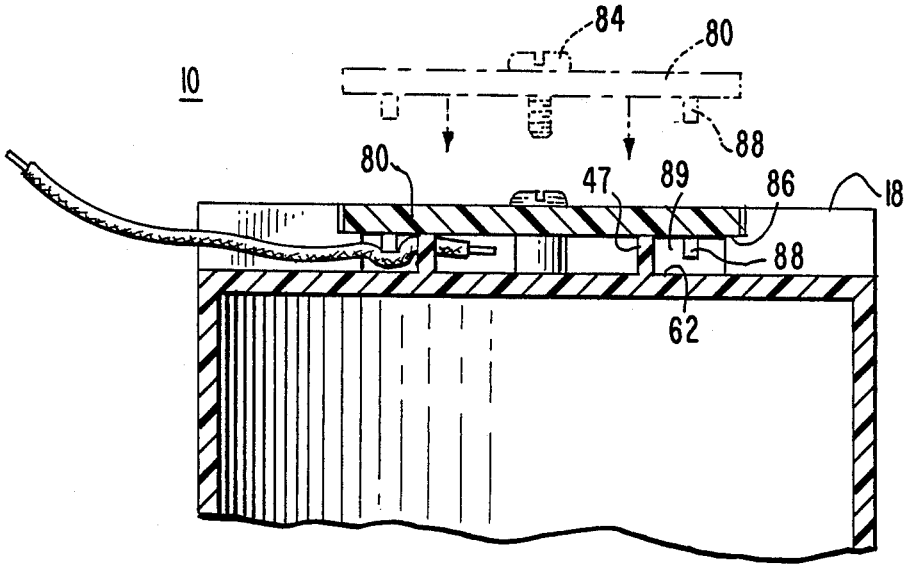
FIG. 8 is an enlarged fragmentary sectional view of FIG. 4, showing an electrical cord in position in the cord viaduct with the cap rib bending the cord supported by the cord guide and urging the cord against the outer surface of the closed end of the fixture.

In accordance with the invention, a plurality of spaced axially extending cord guide means are formed on the outer surface of the closed end adjacent to the wire connecting screws. As embodied herein, as best illustrated by FIGS. 5, 7 and 8, four angularly spaced cord guides 47 are each comprised of a rib 48 axially extending a predetermined distance from the outer surface 18 of closed end 16 and spaced between shaped recesses 31 (see FIGS. 3 and 7) and located in the vicinity adjacent to openings 34. At opposite ends of each of the ribs 48 are a pair of hyperextending guideposts 50 to define notch 52 in cord guide 47 for holding an electrical cord in position on rib 48 (see FIG. 7).

In the preferred embodiment as best illustrated in FIGS. 7 and 8, outer surface 18 of closed end 16 has a concentric circular cavity 60 molded in the closed end 16 and having a bottom 62 of predetermined depth and walls 64 of corresponding height. Four radially extending viaducts 66 each of which have a predetermined width substantially equivalent to the width of notch 52 in cord guides 47 extend from cavity 60 to outer perimeter 61 of receptacle 12 and are aligned with and spaced from a corresponding cord guide 47. Viaduct bottom 68 is coplanar with cavity bottom 62. Viaducts 66 are alternately spaced from lands 70 in outer surface 18 of closed end 16. Lands 70 may be provided with vents 72 for heat dissipating air flow axially through receptacle 12 via annular gap 47 and reflector vents 41.

Further in accordance with the invention, a cover means is removably fastened to the outer surface of the closed end having projecting means aligned with and spaced from the cord guides for bending an electrical cord supported by the cord guides into clamping engagement with outer surface of closed end. As embodied herein and best shown in FIGS. 7 and 8, cap 80 has a diameter for covering cavity 60 and is removably fastened to diametrically opposed standards 82 bored to receive the shank of fastening screw 84 and extending axially from the cavity bottom 62 to a predetermined height substantially equivalent to the height of guideposts 50 of cord guides 47. Ridge 86 is provided at inner edge of cavity 60 and dimensioned for seating cap 80 in position flush with lands 70. Protruding annular rib 88 of cap 80 extends a predetermined distance into an annular gap 89 between cord guides 47 and cavity walls 64, terminating in the vicinity below notch 52 in cord guides 47 and above the cavity bottom 62. The dimensional and positional relationship of guides 47 and annular rib 88 is selected for bending a cord into locking engagement and will vary depending on the size of the cord diameter or the gauge of wire intended for use with the fixture.

Figure 6:
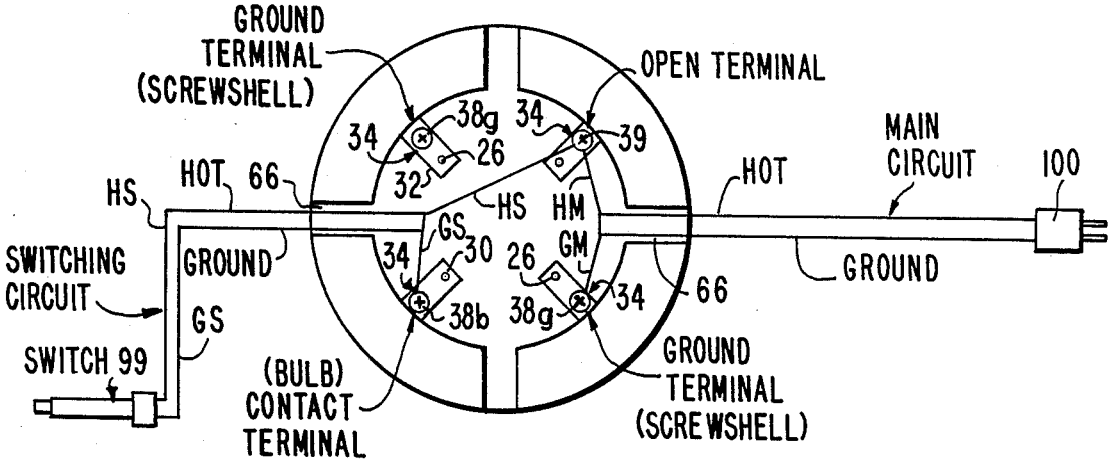
FIG. 6 shows a typical wiring configuration with an external main circuit and an external switching circuit connected to the wire connectors of the fixture of FIG. 1.

In accordance with the invention and in connecting light fixture 10 with reference to FIG. 6, an external main circuit comprising a ground wire GM and a hot wire HM are routed through one of the viaducts 66. Ground wire GM and hot wire HM with insulation still intact are placed between posts 50 on the cord guide rib 48 which is aligned with the particular viaduct 66 through which the wires pass. Ground wire GM is then attached to screw connector **38*g* which is the ground terminal adjacent to rivet 26 connected to screwshell 24. Hot wire HM is then attached to screw connector 39, which is the dead or open terminal. A switch 99 of an external switching circuit has connected thereto a pair of wires HS and GS, which are routed through another of the viaducts 66 and placed on the respective aligned rib 48 of cord guide 47 between posts 50. Ground wire GS of the switch 99 is connected to bulb contact terminal screw 38*b*. The other switch wire HS is connected to open terminal 39 in contact with wire HM. Screw connector 39 fastens both wires HM and HS to each other and to closed end 16 of the receptacle. Thus, when plug 100 is connected to a voltage source, a circuit is completed through wire HM, screw terminal 39, wire HS, closed switch 99, wire GS, terminal 38***b*, terminal 38*g* and wire GM. Cap 80 is fastened into position with rib 88 bending wires GM and HM over one respective cord guide 47 and wires GS and HS over another respective cord guide 47 into clamping engagement with outer surface 18 of the closed end 16, thereby securing the cord against pull and strain forces on respective wire connecting screws 38*b*, 38*g* and 39. As shown in FIGS. 1 and 3, in mounting the fixture 10 in an aperture in a display case shelf (not shown), for example, slideably mounted circular bracket 90 is positioned around the receptacle 12 at the desired axial location and opposing tabs 92 are fastened and tightened with adjustment screw 94. Flanges 96 are provided with holes 98 for receiving mounting screws (not shown). Fixture 10 may be used with a 25 watt intermediate base bulb, however, bulbs of greater or lesser wattage and larger or smaller bases could be accommodated in the present invention depending on the diameter of receptacle 12 and screwshell 14. Preferably, plastics for use in the present invention include Ultem (polyethermide), Torlon (poly(amide-imide)) or Ryton (polyphylene sulfide).

It will be apparent to those skilled in the art that various modifications, variations and additions can be made in the light fixture of the present invention without departing from the spirit or scope of the present invention. Thus, it is intended that the present invention cover the modifications and variations provided they come within the general scope of the claims and their equivalents.

What is claimed is:

1. A light fixture, comprising:

a unipartite thermoplastic hollow annular receptacle having an open end and a closed end, said closed end having an inner and an outer surface;

a cylindrical screwshell centrally disposed in said receptacle on the inner surface thereof;

a plurality of spaced conductive contact means disposed in the screwshell, said contact means extending to the outer surface of the closed end;

a plurality of wire connectors connected to respective contact means on the outer surface of the closed end for connecting one end of a wire thereto;

a light reflector mounted in said receptacle, said reflector having a central opening adjacent to the closed end for receiving the screwshell, said reflector facing the open end of the receptacle;

a plurality of spaced axially extending cord guide means formed on the outer surface of the closed end adjacent to the wire connectors; and cover means removably fastened to the outer surface of the closed end, said cover means having projecting means aligned with and spaced from the plurality of cord guide means for bending an electrical cord supported by the cord guide means into clamping engagement with the outer surface of the closed end for securing the cord against pull and strain forces on a respective wire connector.

2. A light fixture as recited in claim 1, wherein one of the plurality of wire connectors is for electrically and mechanically connecting one of the ground and hot wires of an external main circuit to a respective contact means, and another of the plurality of wire connectors is for electrically and mechanically connecting a wire from one side of an external switching circuit, said fixture further comprising a wire connecting means for mechanically and electrically connecting the other of the ground and hot wires of the external main circuit to a wire from the other side of the external switching circuit.

3. A light fixture as recited in claim 1, wherein the outer surface of the closed end has a cavity of predetermined depth formed therein and the pluralities of wire connectors and cord guide means are disposed in said cavity.

4. A light fixture as recited in claim 1, wherein the inner surface of the closed end is in the form of an annular protrusion extending axially toward the open end of the receptacle for receiving at least a portion of the screwshell; said protrusion having an annular shoulder formed on the edge thereof for mating with and positioning the reflector.

5. A light fixture as recited in claim 1, wherein the inner surface has formed thereon and substantially central thereto a pair of opposed ridges, spaced apart a predetermined distance and protruding axially toward the open end of the receptacle; said ridges having disposed therebetween a shaped recess formed in the inner surface; said shaped recess for receiving one of the spaced conductive contact means; said one of the contact means being a bulb contact; said ridges for preventing said bulb contact from moving upon installation of a bulb base in the screwshell.

6. A light fixture as recited in claim 1, further comprising a circular bracket slideably mounted on the receptacle, said bracket having tightening means for fixing said bracket at a selected axial position and a plurality of flanges extending radially from the receptacle for attaching the bracket to an external surface.

7. A light fixture as recited in claim 1, wherein said thermoplastic receptacle is polyphylene sulfide (Ryton).

8. A light fixture as recited in claim 1, wherein said thermoplastic receptacle is polyethermide (Ultem).

9. A light fixture as recited in claim 1, wherein said thermoplastic receptacle is polyamide-imide (Torlon).

10. A light fixture, comprising:

a unipartite thermoplastic hollow cylindrical receptacle having an open end and closed end, said closed end having an outer surface and an inner surface, said inner surface being in the form of an annular protrusion extending axially toward the open end of the receptacle;

said outer surface having a concentric circular cavity aligned with the annular protrusion and defining a bottom of predetermined depth in said cavity;

concentric ridge means disposed at the inner edge of the cavity in the closed end of the fixture;

said outer surface having a plurality of shaped recesses formed on the bottom of the cavity;

a cylindrical screwshell coaxially disposed in the annular protrusion;

a plurality of conductive contact means fastening said screwshell to the inner surface of the closed end, said contact means extending through the closed end to the bottom of the cavity and aligned with the corresponding shaped recesses in the outer surface;

a pair of opposed ridges, spaced apart a predetermined distance and protruding axially toward the open end of the receptacle; said ridges having disposed therebetween a shaped recess formed in the inner surface; said shaped recess for receiving one of the spaced conductive contact means; said one of the contact means being a bulb contact; said ridges for preventing said bulb contact from moving upon installation of a bulb base in the screwshell;

a plurality of wire terminals disposed on the outer surface, said wire terminals radially spaced from the corresponding contact means for connecting wire thereto;

a plurality of conductive metal strips disposed in the shaped recesses and connecting the wire terminals to the corresponding contact means;

an open wire terminal disposed in one of the shaped recesses on the outer surface, spaced from the plurality of wire terminals and the corresponding contact means and electrically insulated therefrom; said open wire terminal for connecting wire thereto;

a plurality of angularly spaced viaduct means extending between the walls of the cavity and the perimeter of the fixture, said viaduct means for receiving an electrical cord;

said receptacle having a plurality of spaced vents formed in the closed end for heat dissipating air flow through the receptacle;

a plurality of spaced axially extending cord guide means formed on the bottom of the cavity adjacent to the wire terminals and aligned with corresponding viaduct means, said cord guide means dimensioned to form an annular gap between said cord guide means and the viaduct means and having diametrically opposed hyperextending guideposts forming a notch for holding the cord in position;

a cover means dimensioned to cover the cavity and removably fastened to a plurality of diametrically opposed standards axially extending from the bottom of the cavity and adjacent to the wire terminals, said cover means for engaging the cord supported by the cord guide means thereby absorbing pull and strain forces placed on the wire terminals disposed at the inner edge of the cavity in the closed end of the fixture;

a light reflector having a frustro-conical portion and a hollow cylindrical portion extending axially from the frustro-conical portion in the direction of the closed end, said reflector attached coaxially to the socket and having a central opening in the hollow cylindrical portion spaced from and receiving the screwshell, said frustro-conical portion facing the open end of the receptacle and dimensioned to form an annular gap between the receptacle and the reflector.

11. A light fixture as recited in claim 10, wherein said cover means includes a cap seated flushly in the concentric ridge means.

12. A light fixture as recited in claim 10, wherein said cover means includes a protruding annular rib extending into the cavity in the annular gap between the cord guide means and the cavity walls at the closed end of the fixture for bending an electrical cord supported by the cord guide means into clamping engagement with the outer surface of the closed end.

13. A light fixture, comprising:

a unipartite thermoplastic hollow annular receptacle having an open end and a closed end, said closed end having an inner and an outer surface, and a cavity of predetermined depth formed therein;

a cylindrical screwshell centrally disposed in said receptacle on the inner surface thereof;

a plurality of spaced conductive contact means disposed in the screwshell, said contact means extending to the outer surface of the closed end;

a plurality of wire connectors disposed in the cavity and connected to respective contact means on the outer surface of the closed end for connecting one end of a wire thereto;

a light reflector mounted in said receptacle, said reflector having a central opening adjacent to the closed end for receiving the screwshell, said reflector facing the open end of the receptacle;

a plurality of spaced axially extending cord guide means disposed in the cavity adjacent to the wire connectors; and cover means removably fastened to the outer surface of the closed end, said cover means having projecting means aligned with and spaced from the plurality of cord guide means for bending an electrical cord supported by the cord guide means into clamping engagement with the outer surface of the closed end for securing the cord against pull and strain forces on a respective wire connector.

14. A light fixture, comprising:

a unipartite thermoplastic hollow annular receptacle having an open end and a closed end, said closed end having an inner and an outer surface, said inner surface of the closed end being in the form of an annular protrusion extending axially toward the open end of the receptacle and having an annular shoulder formed on the edge thereof;

a cylindrical screwshell centrally disposed in said receptacle on the inner surface thereof, at least a portion of said screwshell being received and surrounded by the annular protrusion;

a plurality of spaced conductive contact means disposed in the screwshell, said contact means extending to the outer surface of the closed end;

a plurality of wire connectors connected to respective contact means on the outer surface of the closed end for connecting one end of a wire thereto;

a light reflector mounted in said receptacle and mated with and positioned by the annular shoulder formed on the edge of the annular protrusion, said reflector having a central opening adjacent to the closed end for receiving the screwshell, said reflector facing the open end of the receptacle;

a plurality of spaced axially extending cord guide means formed on the outer surface of the closed end adjacent to the wire connectors; and cover means removably fastened to the outer surface of the closed end, said cover means having projecting means aligned with and spaced from the plurality of cord guide means for bending an electrical cord supported by the cord guide means into clamping engagement with the outer surface of the closed end for securing the cord against pull and strain forces on a respective wire connector.

15. A light fixture, comprising:

a unipartite thermoplastic hollow annular receptacle having an open end and a closed end, said closed end having an inner and an outer surface;

a cylindrical screwshell centrally disposed in said receptacle on the inner surface thereof;

a plurality of spaced conductive contact means disposed in the screwshell, said contact means extending to the outer surface of the closed end;

a plurality of wire connectors connected to respective contact means on the outer surface of the closed end for connecting one end of a wire thereto;

a light reflector mounted in said receptacle, said reflector having a central opening adjacent to the closed end for receiving the screwshell, said reflector facing the open end of the receptacle;

a plurality of spaced axially extending cord guide means formed on the outer surface of the closed end adjacent to the wire connectors;

cover means removably fastened to the outer surface of the closed end, said cover means having projecting means aligned with and spaced from the plurality of cord guide means for bending an electrical cord supported by the cord guide means into clamping engagement with the outer surface of the closed end for securing the cord against pull and strain forces on a respective wire connector; and a pair of opposed ridges formed on the inner surface and substantially central thereto, said pair spaced apart a predetermined distance and protruding axially toward the opened of the receptacle, said pair having disposed therebetween a shaped recess formed in the inner surface, said shaped recess for receiving one of the spaced conductive contact means, said one of the contact means being a bulb contact, said ridges for preventing said bulb contact from moving upon installation of a bulb base in the screwshell.

* * * * *